US010215140B2

(12) United States Patent
Allen et al.

(10) Patent No.: US 10,215,140 B2
(45) Date of Patent: Feb. 26, 2019

(54) FUEL CONTROL VALVE ASSEMBLY

(71) Applicant: Turn and Bank Holdings, Inc., Gibsonville, NC (US)

(72) Inventors: Michael Allen, Graham, NC (US); Timothy Henderson, Gibsonville, NC (US)

(73) Assignee: Turn and Bank Holdings, LLC, Gibsonville, NC (US)

( * ) Notice: Subject to any disclaimer, the term of this patent is extended or adjusted under 35 U.S.C. 154(b) by 97 days.

(21) Appl. No.: 15/152,155

(22) Filed: May 11, 2016

(65) Prior Publication Data

US 2017/0022948 A1 Jan. 26, 2017

Related U.S. Application Data

(63) Continuation-in-part of application No. 15/009,043, filed on Apr. 14, 2016.

(60) Provisional application No. 62/147,042, filed on Apr. 14, 2015, provisional application No. 62/159,959, filed on May 11, 2015.

(51) Int. Cl.
*F02M 37/00* (2006.01)

(52) U.S. Cl.
CPC .... *F02M 37/0023* (2013.01); *F02M 37/0047* (2013.01)

(58) Field of Classification Search
CPC .... F02M 37/0047; F02M 69/52; F02M 69/24; F02M 37/0023; F16K 1/224; F16K 1/225
See application file for complete search history.

(56) References Cited

U.S. PATENT DOCUMENTS 2,897,022 A * 7/1959 Marola ..... F16C 35/063 384/584
4,288,665 A * 9/1981 Smith ..... F16K 31/05 200/18
5,370,361 A * 12/1994 Mendell ..... F16K 1/22 251/305
6,969,287 B1 * 11/2005 Motsenbocker ..... B63H 5/165 440/1
2004/0011327 A1 * 1/2004 Oyamada ..... F02M 37/043 123/337
2010/0000612 A1 * 1/2010 Gebler ..... F16K 5/0652 137/15.17
2010/0270489 A1 * 10/2010 Mendoza ..... B64D 13/02 251/308
2012/0194958 A1 * 8/2012 Matthiesen ..... H01H 37/761 361/103
2016/0201826 A1 * 7/2016 Hatton ..... F02B 39/00 251/304

FOREIGN PATENT DOCUMENTS

WO WO 2015031220 A1 * 3/2015 ..... F02B 39/00

* cited by examiner

*Primary Examiner* — Marina Tietjen
(74) *Attorney, Agent, or Firm* — Richard T. Matthews; Williams Mullen

(57) ABSTRACT

A fuel control valve assembly that includes a ball bearing assembly and retainer assembly for a mixture control valve assembly and idle control valve assembly in use with general aviation fuel injector servos is disclosed. The assembly desirably reduces friction and wear on the components of the fuel control valve assembly.

20 Claims, 10 Drawing Sheets

SCALE 2:1

SCALE 2:1

SCALE 3:1

SCALE 2:1

SCALE 3:1

FUEL CONTROL VALVE ASSEMBLY

CROSS-REFERENCE TO RELATED APPLICATIONS

This application is a Continuation in Part of U.S. patent application Ser. No. 15/099,043 filed Apr. 14, 2016, which claims priority to U.S. Provisional Patent Application 62/147,042, filed Apr. 14, 2015, both of which are fully incorporated herein by reference. This application also claims priority to U.S. Provisional Patent Application No. 62/159,959 filed May 11, 2015, which is fully incorporated herein by reference.

STATEMENT REGARDING GOVERNMENT SUPPORT

None.

FIELD OF THE INVENTION

The present invention relates to a fuel injection system and valve body assemblies. More specifically, the present invention relates to a fuel injection servo system for an aircraft engine and improved valve assemblies related thereto.

BACKGROUND

Fuel injection systems have replaced carburetors in most modern aircraft engines. Presently, fuel injection systems provide greater performance, economy, and reliability relative to their carburetor counterparts.

Most prior art fuel injection systems used in aircraft engines are volume-air flow type systems, which are based on the principle of measuring air flow to establish correct fuel flow to the engine cylinders. These systems include a throttle body fuel injection servo which measures the amount of air moving past the throttle by use of a venturi. An in-line diaphragm type flow regulator then converts the air pressure from the venturi into a proportional fuel pressure. During normal operation of the aircraft engine, the position of the throttle controls the air flow through the fuel injection servo or to the regulator, which then controls the flow of fuel to the cylinders. The servo is the primary component used in the fuel injection system and performs all functions required to establish fuel flow volumes. The regulated fuel flow from the servo is sent to a fuel flow divider, which divides the steady stream of fuel into smaller streams of fuel, one for each cylinder. Fuel lines carry fuel from the divider to injector nozzles located in the intake ports of each cylinder. The injectors supply fuel to the intake manifold. Fuel then enters the cylinders from the intake manifold under the low pressure created in the cylinder during the intake cycle.

During normal operation of the aircraft engine, the position of the throttle and the air flowing through the fuel injection servo or flow regulator controls the flow of fuel to the cylinders of the aircraft engine. As the throttle is opened, more fuel is delivered to each cylinder, resulting in an increase in the speed of the engine or in manifold pressure, and thus more power being generated by the engine. Generally, most fuel injection servos include an air passage mechanism (i.e., the throttle body), a fuel pressure modifying mechanism (i.e., the valve assembly), and a fuel regulator assembly.

FIG. 1 is a schematic cross-sectional view of a prior art fuel injection system as representative of a Precision Airmotive, LLC brand RSA-5AD1™ RSA-5AB1™ or RSA-10AD1™ system. In the top-left of FIG. 1, a valve assembly 100 is shown that includes a mixture control valve 101 and idle control valve 102. The fuel injection system includes a fuel inlet to accept fuel from, for example, a fuel pump (not shown) before directing such fuel through the fuel strainer and into the cavity housing the mixture control valve and idle control valve. The mixture control valve 101 is connected to the manual mixture control lever 10. A throttle valve is connected to the idle valve lever 12. Within the valve assembly cavity housing is also a metering jet for the delivery of fuel, whereby the idle control valve 102 regulates the metered fuel pressure (shown in dark pink) and the mixture control valve regulates the unmetered (inlet) fuel pressure (shown in red), each to separate sides of a fuel diaphragm housed within the fuel regulator of the servo system.

The valve assembly (i.e., fuel pressure modifying mechanism) receives fuel from a fuel supply and delivers the fuel at a pressure that is different from the fuel supply to the fuel regulator assembly. Some of the major components of valve assembly include an idle valve assembly and a mixture valve assembly. The mixture valve assembly as shown in FIGS. 1 and 2 includes a mixture valve connected to the mixture control lever 10. The mixture valve often has a hollow barrel design of cylindrical shape that allows for rotational operation within a bore formed in the valve body. At one end of the mixture control assembly shaft is a roll pin 12 engaged with the shaft 14 adjacent a clip. About the shaft is a spacer 18, clip 16 and thrust disc 20, where the flat surfaces are pressed against one by way of a spring 11 that presses against a spring seat 13. The spring 11 wraps around the exterior of the shaft and variably a portion of the bushing 15. The bushing 15 may engage the shaft though various seals 17. The lever 10 is connected to the end of the shaft opposite the clip 16, spacer 18 and thrust disc 20, at a point relative to where a second roll pin 12*a* is positioned. Hole(s) in the non-rotation disc through which fuel can flow, and the hole(s) in the mixture valve shaft can align, permitting the flow of fuel. When misaligned, the fuel is shut off. The discs and hole(s) can also partially permit flow when in intermediate positions.

The traditional mixture control assembly is shown in FIGS. 4A-4D, where measurements are relative and may not be drawn to scale. The spring 11 can be seen imparting pressure on the spring seat 13, and thereon to the thrust disc 20 and clip 16 and/or spacer 18 encircling the shaft. In this example, the spring is noted as 0.854 inches in length down the shaft. The mixture control assembly may also include a stop bracket 75.

The idle valve assembly shown in FIGS. 3A and 3B include an idle valve that is connected to the throttle linkage via an idle valve lever 38. The idle valve often has a hollow barrel design of cylindrical shape that allows for rotational operation within a bore formed in the valve body. The idle valve generally includes an opening 31 (e.g., a notch cut approximately half way into the side of valve) which communicates with a channel 32 of the regulator assembly for delivering metered fuel to the regulator. At one end of the opening is often a stepped slot 31. The idle valve effectively reduces the area of the main metering jet for accurate metering of the fuel in the engine idle range.

The idle valve assembly shown in FIGS. 1 and 3 generally includes an idle valve cover (not shown), a thrust washer/disc 35 (generally, polymer or Teflon), an idle lever spacer, and an o-ring seal. The idle valve shaft may further include a flat disc-like flange 30 having small holes or slots 31 therein. The flat disc-like flange 30 (polymer or Teflon) may be held against a second non-rotating flat disc 33 (polymer or Teflon) by a spring (shown in FIGS. 1 and 2) in such a way that the two flat surfaces of the discs are pressed against one another. In certain other embodiments, the second non-rotating flat disc 33 may be positioned opposite and spaced apart from the disc-like flange 30, wherein the flat disc 33 pushes against a polymer washer 35 to reduce friction. In either configuration, the hole(s) in the non-rotation disc through which fuel can flow, and the hole(s) in the idle valve shaft can align, permitting the flow of fuel. When misaligned, the fuel is shut off. The discs and hole(s) can also partially permit flow when in intermediate positions.

The spring load imposed on the discs creates a load on the shaft tending to push in a direction towards outside of the servo housing. Various efforts have been made to alleviate the friction associated with the discs and other components. For example, polymer thrust washers have been employed for years and are sufficiently durable, but do not reduce friction as is desired. Teflon washers are also utilized, but friction remains.

The friction and stiffness resulting from the spring-load bearing washer system ("thrust washers") results in throttle friction. Such stiffness has also led to 'jumpy' control settings. Worse, microscopic wear particles thought to be generated from the thrust washers may coalesce with certain constituents (or contamination) in the aviation gasoline found in various regions around the world, particularly the south Asia region. These particles are purported to form particle aggregations that flow downstream, contaminating the fuel system.

The spring tension and size, coupled with the clip(s) (e.g., c-clip), washers, and other components leave little room for modifications, particularly where such componentry has long been approved by the Federal Aviation Administration.

A fuel injection system which avoids the shortcomings attendant with the prior art devices and practices utilized heretofore is the subject matter of the present application. The throttle control lever is mechanically linked to a valve which controls fuel to the engine when the throttle is at or very near closed (idle). In various fuel injection servo systems, when the throttle is moved, the idle valve moves. It is often in the idle valve assembly that the high friction affecting throttle movement occurs.

SUMMARY OF THE INVENTION

It should be appreciated that this Summary is provided to introduce a selection of concepts in a simplified form, the concepts being further described below in the Detailed Description. This Summary is not intended to identify key features or essential features of this disclosure, nor is it intended to limit the scope of the invention.

The present invention dramatically reduces the friction in the throttle and mixture control lever systems, and eliminates the need for polymer or Teflon thrust washers in the fuel injector servo that can be a source of foreign particles that can interact with other materials and contaminate the system.

In some embodiments, a fuel mixture control assembly is disclosed including a shaft, a stop bracket adapted to be secured on one end of the shaft, a spring arranged over a portion of the shaft, a spring retainer adapted to retain a first end of the spring opposite the stop bracket, a retainer assembly, and a bearing assembly arranged between the spring retainer and the retainer assembly.

In some embodiments, an idle fuel control assembly is disclosed including a shaft, a bracket adapted to be secured on one end of the shaft, an idle valve member rotationally engaged about the shaft, a retainer assembly, and a bearing assembly arranged adjacent the retainer assembly and the idle valve member.

DETAILED DESCRIPTION

Figure 1:
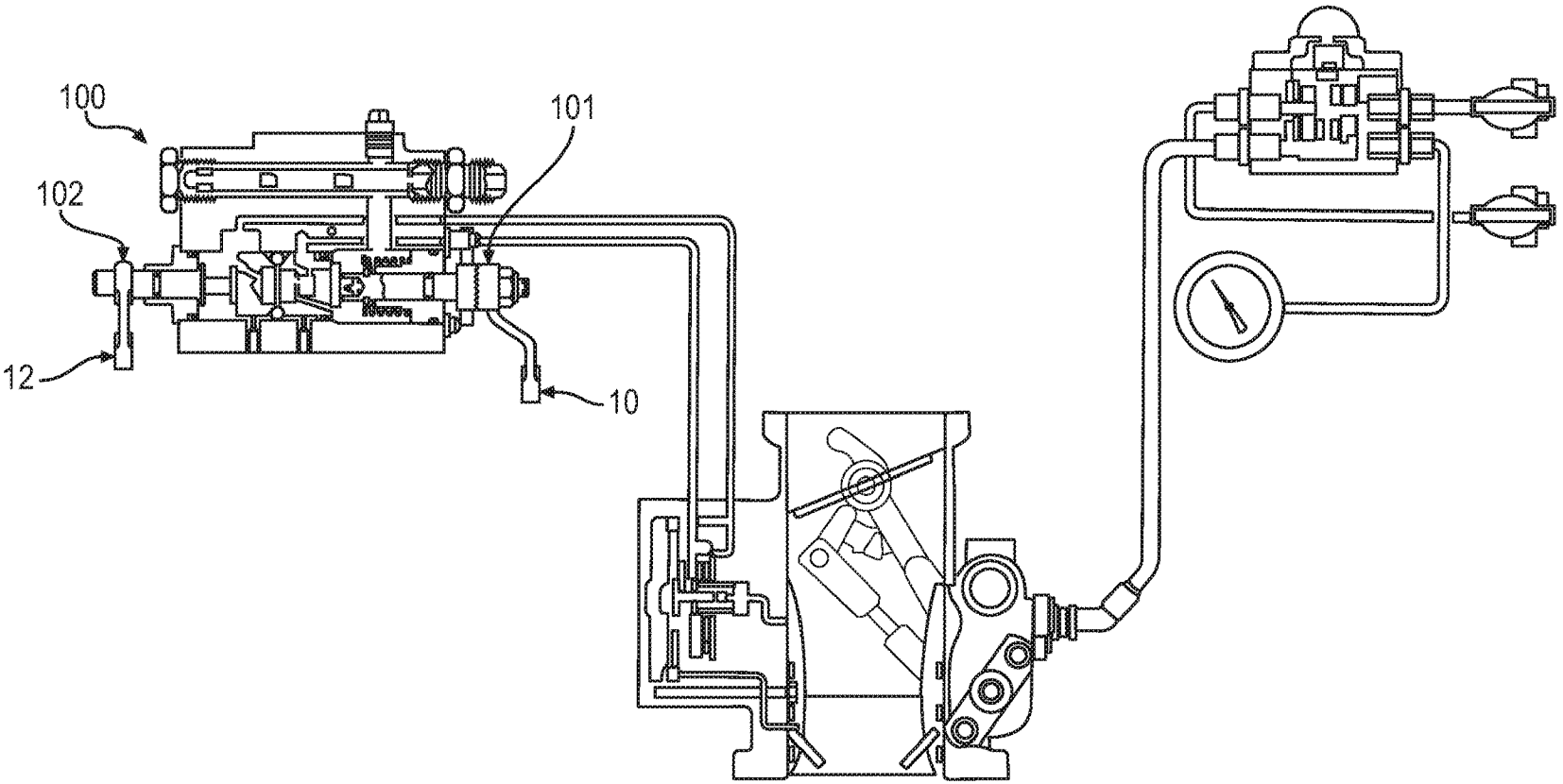
FIG. 1 is a schematic cross-sectional view of a prior art fuel injection system.
Figure 2:
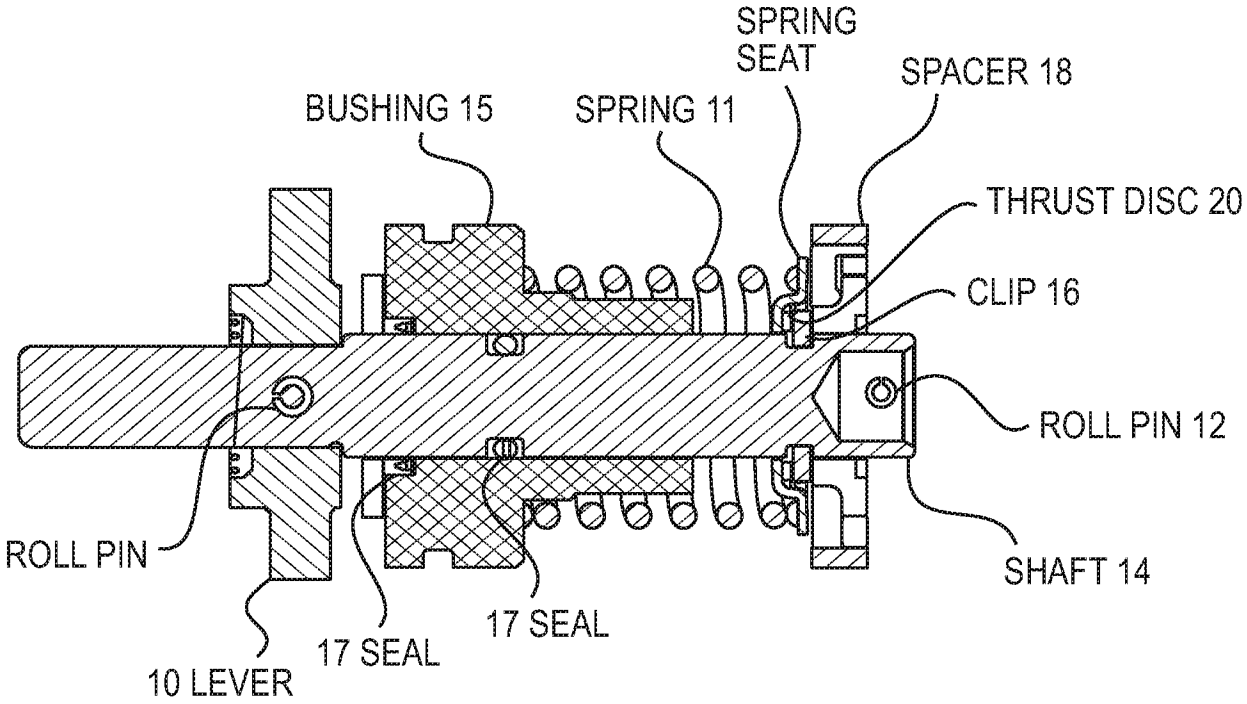
FIG. 2 is a cross-sectional view of a prior art mixture control assembly.
Figure 3B:
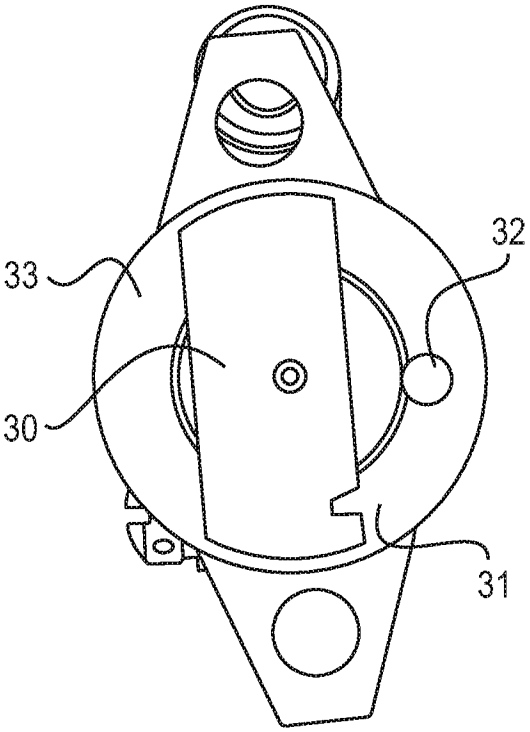
FIGS. 3A and 3B are a cross-sectional view of a prior art idle control assembly from side and longitudinal perspectives, respectively.
Figure 3A:
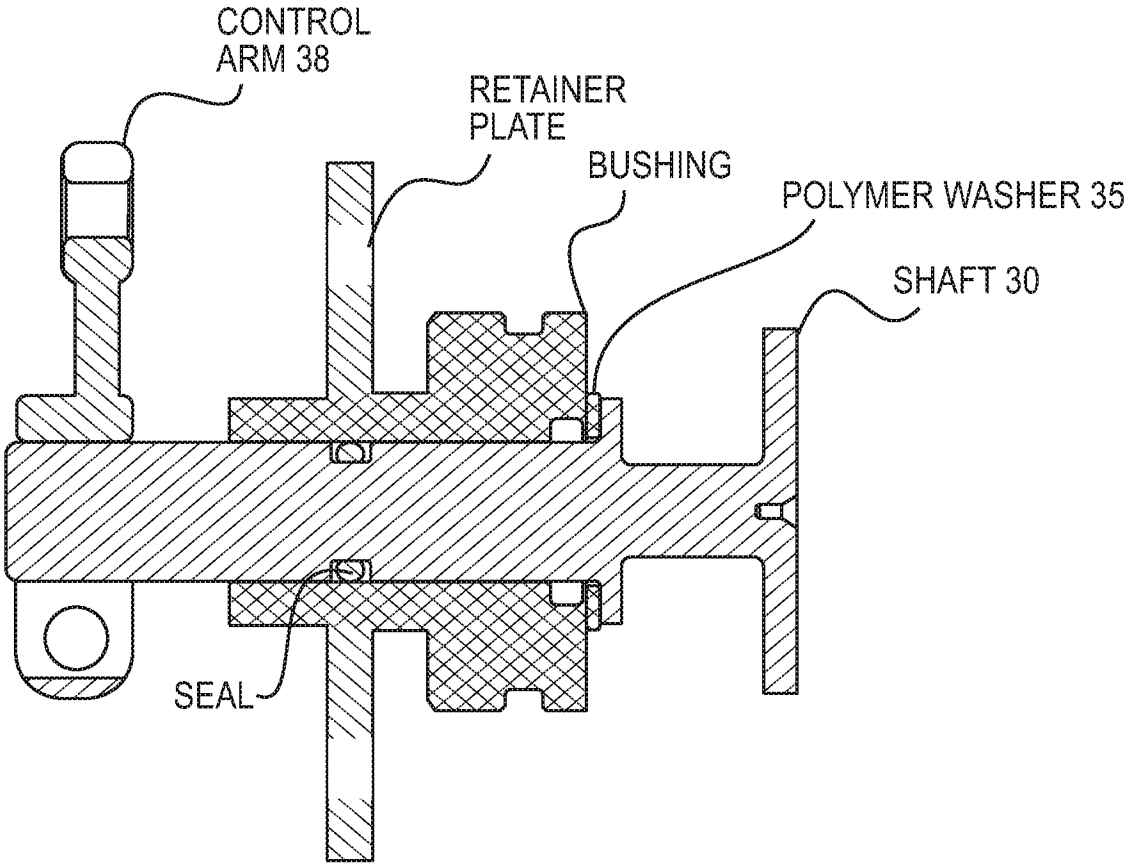
Figure 4A:
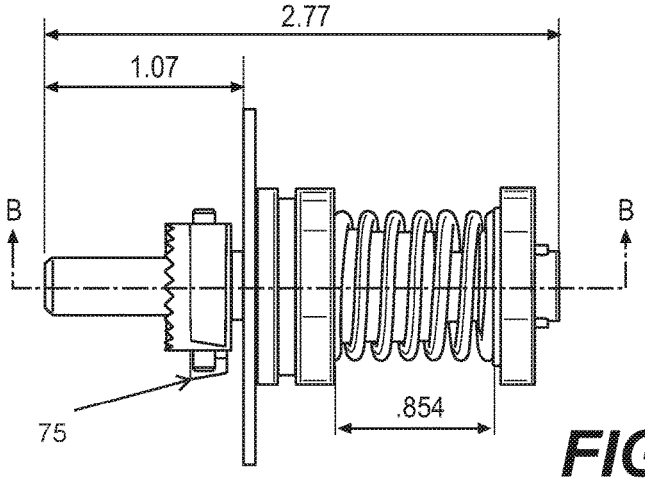
FIG. 4A is a side view of a prior art mixture control assembly.
Figure 4C:
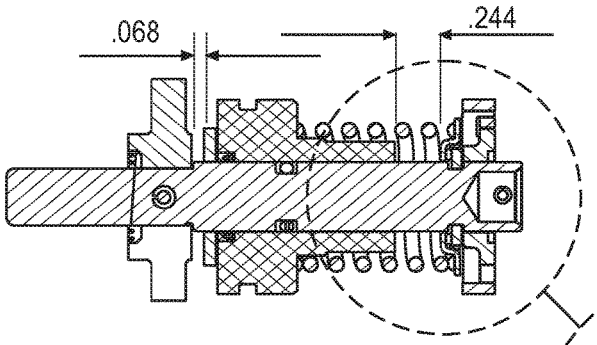
FIG. 4C is a cross-sectional view of a prior art mixture control assembly.
Figure 4D:
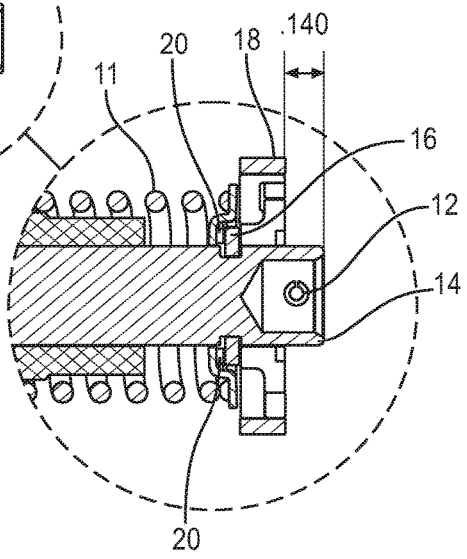
FIG. 4D is a close-up cross-sectional view of a portion of the prior art mixture control assembly shown in FIGS. 4A-4C.
Figure 4B:
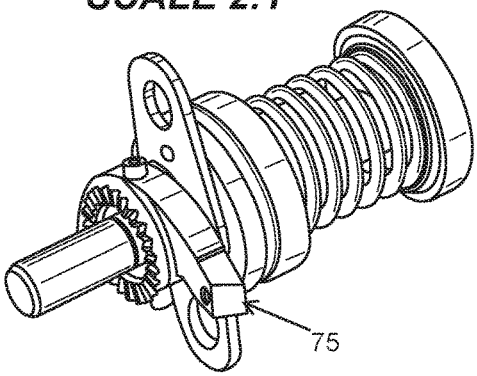
FIG. 4B is a perspective view of a prior art mixture control assembly.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain components or features may be exaggerated for clarity, and broken lines may illustrate optional features or elements unless specified otherwise. In addition, the sequence of operations (or steps) is not limited to the order presented in the figures and/or claims unless specifically indicated otherwise. Features described with respect to one figure or embodiment can be associated with another embodiment or figure although not specifically described or shown as such.

It will be understood that when a feature or element is referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations in use or operation in addition to the orientation depicted in the figures.

It will be understood that although the terms first and second are used herein to describe various features or elements, these features or elements should not be limited by these terms. These terms are only used to distinguish one feature or element from another feature or element. Thus, a first feature or element discussed below could be termed a second feature or element, and similarly, a second feature or element discussed below could be termed a first feature or element without departing from the teachings of the present invention.

Unless otherwise defined, all terms (including technical and scientific terms) and phrases used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

The term "about", as used herein with respect to a value or number, means that the value or number can vary by +/− twenty percent (20%). The terms "about," "somewhat," etc., with respect to structural or functional inter-relations apart from values or numbers are used to convey that an absolute inter-relation is not required, so as the elements satisfy the described purpose within such inter-relation.

Conventionally, as noted above, the frictional engagement inside the valve assembly of the washers, clips and bushings retained in place by the shaft and spring, impart minimal room for additions or modifications. In some embodiments of the present invention, a ball bearing assembly is included with a shortened spring that is comparably as strong as the prior art springs.

Figure 5A:
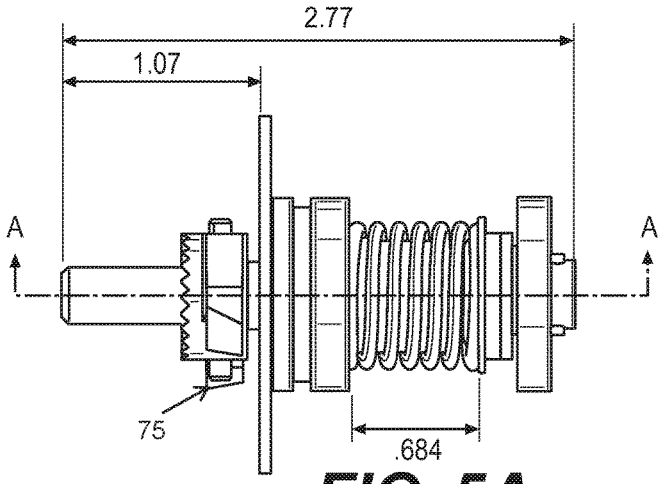
FIG. 5A is a side view of a mixture control assembly according to one embodiment of the present invention.
Figure 5C:
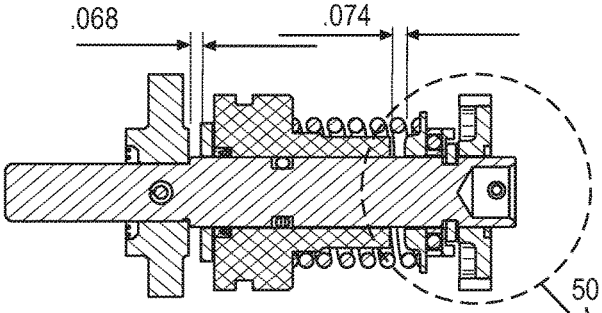
FIG. 5C is a cross-sectional view of a mixture control assembly according to one embodiment of the present invention.
Figure 5B:
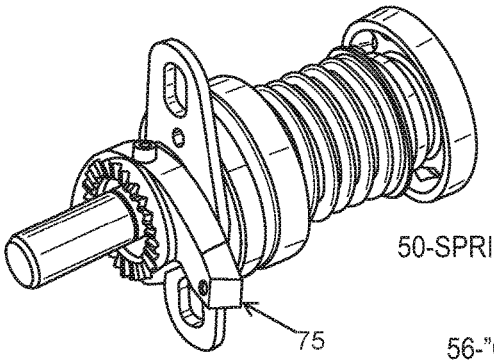
FIG. 5B is a perspective view of a mixture control assembly according to one embodiment of the present invention.
Figure 5D:
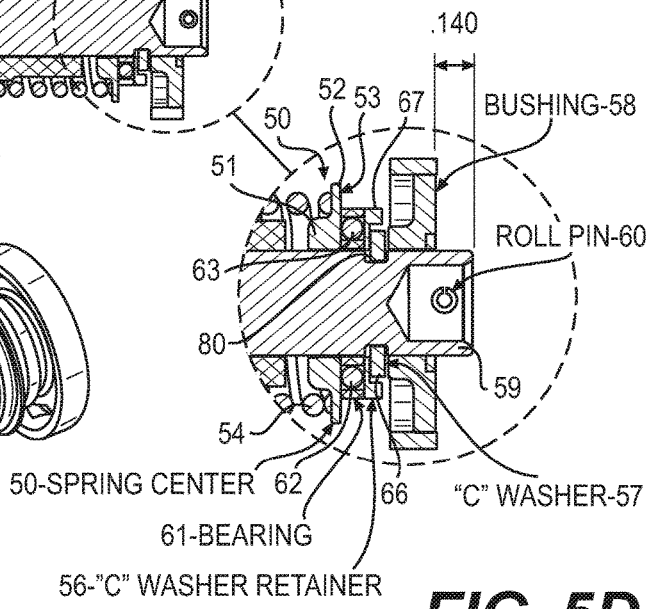
FIG. 5D is a close-up cross-sectional view of a portion of the mixture control assembly shown in FIG. 5C according to one embodiment of the present invention.

FIGS. 5A-5D represent various embodiments of the present invention that reduce friction in the mixture control assembly. In some embodiments shown in FIG. 5D, the present invention includes a mixture valve assembly 55 including a spring retainer 50, a ball bearing assembly 61, a washer retainer 56, and a washer 57. Referring to FIGS. 5A and 5B, the mixture control assembly may further include a stop bracket 75. Additional common parts to a mixture valve assembly may be included a bushing 58 (that may be resized to fit the components of the various embodiments herein), a shaft 59, and a roll pin 60.

In some embodiments, the cross-sectional design of the spring retainer 50 has a distinctive cross-sectional design. In some embodiments, the spring retainer 50 is includes a rounded insert 51 sized to extend into at least a portion of the internal circumference of the spring. In some embodiments, the spring retainer 50 includes a shelf 52 on one end of the spring retainer 50 including a circumference sized to accommodate and retain the spring. In some embodiments, the shelf 52 is rounded and of a circumference generally at or near the exterior circumference of the spring 54 (and of greater circumference than the insert 51). Opposite the rounded insert 51, the spring retainer 50 includes a flat surface 53 (extending along the shelf 52) for meeting the ball bearing assembly 61.

The ball bearing assembly 61 in some embodiments includes a baring cage 63 with one or more balls 62 (e.g., stainless steel) sized to fit within ball-sized spaces in the cage 63. The ball bearing assembly 61 substantially reduces or eliminates friction in the operation of the mixture control assembly 55, thereby reducing 'jumpy' control settings and/or foreign particle generation.

In some embodiments, a washer retainer 56, includes a flat surface 65 for meeting the ball bearing assembly 61 opposite the spring retainer 50. Opposite the flat surface 65, the washer retainer 56 includes a seat 66 sized to fit a washer 57 (e.g., C-washer) that may lock into place along the shaft 59 opposite the bushing 58. The washer retainer 56 may also include a lip 67 to aid in retaining the washer 57.

Figure 11:
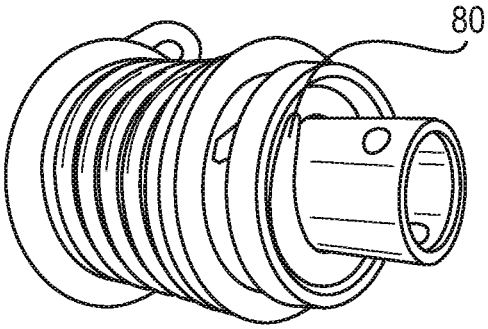
FIG. 11 is a close-up perspective picture of a mixture control assembly according to one embodiment of the present invention.
Figure 12:
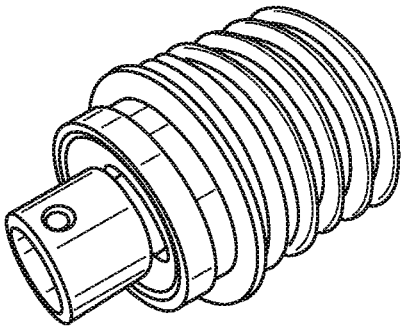
FIG. 12 is a close-up perspective picture of a mixture control assembly according to one embodiment of the present invention.

In some embodiments, the bushing(s) may be consistent in size with prior devices. In some embodiments, the bushing may be reduced in size to reduce the amount of change in size required of the spring. The spring 54 may be reduced in size (e.g., from 0.854 inch. to 0.684 inch.), while the strength increased to accommodate the reduction in size. FIGS. 7-12 show various pictures of the mixture valve assembly 55 of the present invention. FIG. 11 shows the washer 57 housed in a slot 80 of the shaft 59 for retaining the washer in place.

Figure 6B:
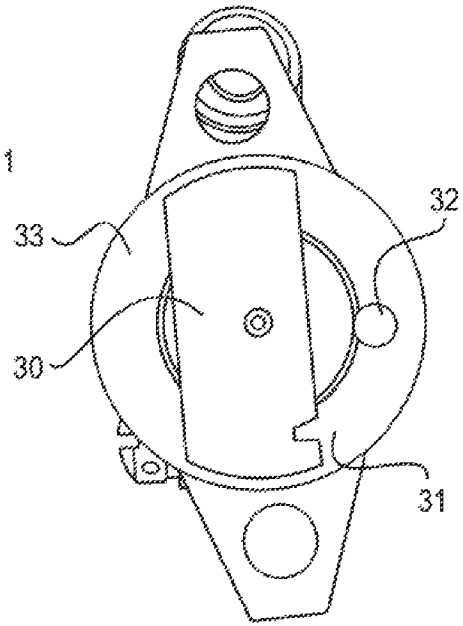
FIG. 6 is a cross-sectional view of an idle control assembly according to one embodiment of the present invention.
Figure 6A:
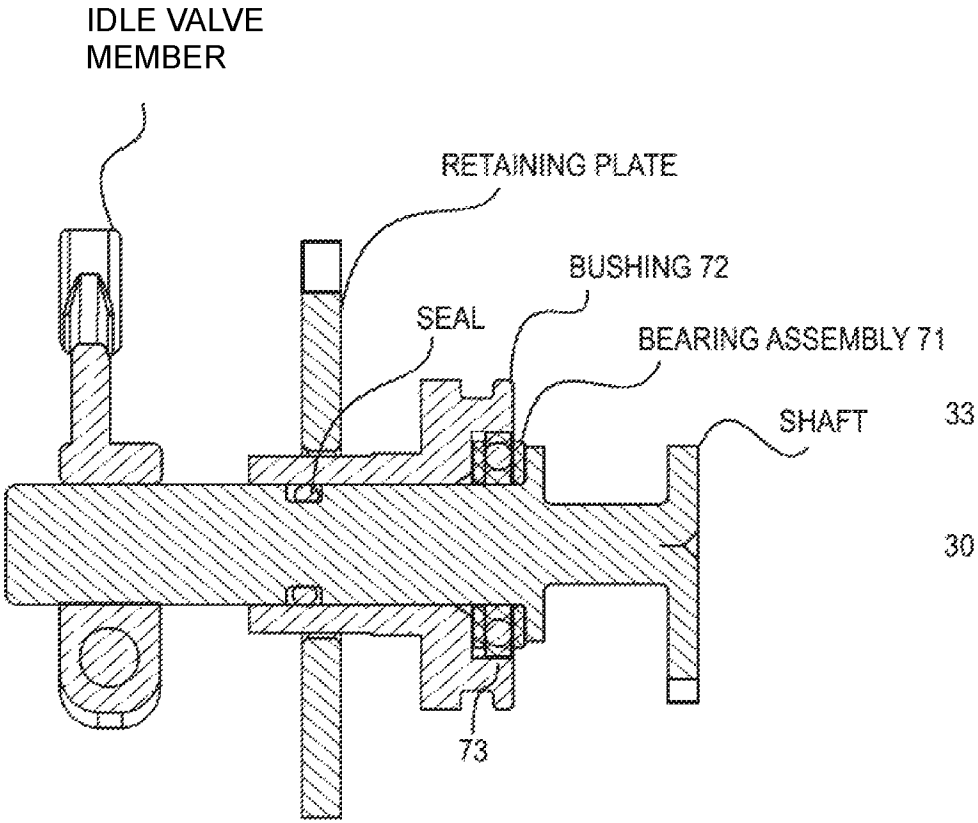
Figure 7:
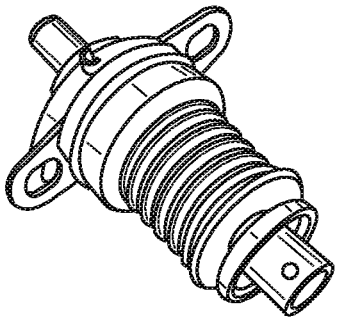
FIG. 7 is a perspective picture of a mixture control assembly according to one embodiment of the present invention.
Figure 8:
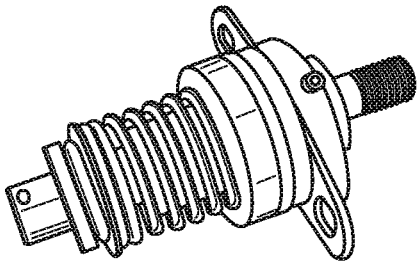
FIG. 8 is a perspective picture of a mixture control assembly according to one embodiment of the present invention.
Figure 9:
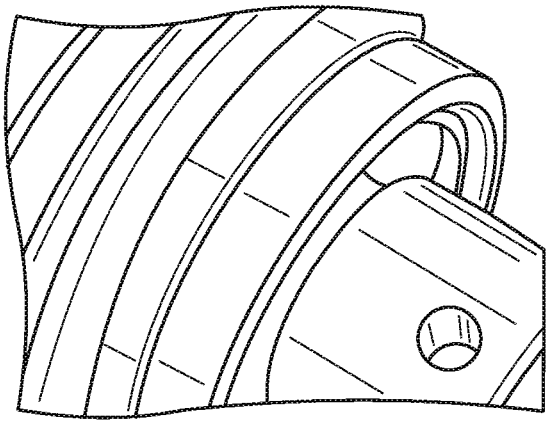
FIG. 9 is a close-up perspective picture of a mixture control assembly according to one embodiment of the present invention.
Figure 10:
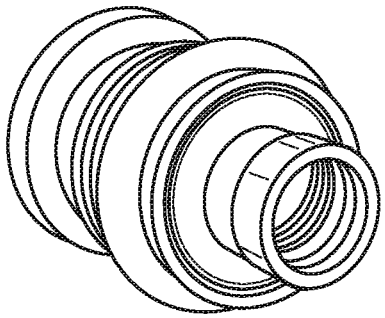
FIG. 10 is a close-up perspective picture of a mixture control assembly according to one embodiment of the present invention.

FIG. 6 represents various embodiments of the present invention that reduce friction in the idle control assembly 70. In some embodiments, an idle control bearing assembly 71 may mirror the size and/or shape of the mixture control ball bearing assembly 61. In some embodiments, an idle control bearing assembly 71 includes an idle bushing 72 may be shaped to include a bushing seat 73 for retaining the idle control bearing assembly 71.

TESTING

A number of tests have been performed to evaluate the various improvements and effectiveness of certain embodiments of the presently disclosed ball bearing assembly for use in the idle valve assembly and/or fuel mixture assembly. Included herein below are two types of tests performed and their corresponding test results. In particular, included below are the methodology and results of various rotation torque tests and a Life Cycle Test.

The testing described hereinbelow was conducted using the RSA® series fuel injection servos manufactured by Precision Airmotive, LLC. The Teflon washers tested were Precision Airmotive part numbers 367757 and 2538330, respectively.

Rotation Torque Tests:

The force required to initiate movement of the mixture control lever and idle lever of RSA® servos, respectively, were carefully measured using both the Teflon washer assembly of the prior art and an embodiment of the presently disclosed ball bearing assembly. The results were then compared to evaluate the effectiveness of certain embodiments of the presently disclosed ball bearing assemblies. Two different rotational torque tests were conducted: a test measuring the force required to initiate movement of the idle lever and mixture control lever in a full servo application, and a modified configuration with certain components removed so as to vary the amount of force on the Teflon washer or ball bearing assembly and measure the required rotational force under different compression/spring loads.

First, the mixture control and idle lever assemblies were built up with their appropriate Teflon washers and installed into a servo body (valve area) with no fuel. The force required to initiate movement of the mixture control lever and idle lever, respectively, was then measured using this traditional configuration. The idle lever assembly was rotational torque tested with idle linkage lever part no. 2523299. The mixture control lever assemblies were tested with linkage lever part no. 2520672.

The mixture control lever and idle lever were then removed, and the respective assemblies converted to an embodiment of the presently disclosed valve system comprising ball bearing assemblies. The levers were then reattached and each tested in the same manner.

Table 1 contains the first test result data of the Rotation Torque Tests. The forces noted in Table 1 relate to all the components that rotate against each other when installed in a servo. Only a portion of the force is related to the friction between the Teflon thrust washer and the components that are pressed up against it. The same applies to the assemblies that were converted to use an embodiment of the thrust ball bearing assembly disclosed herein. In normal operation, the force applied to the thrust washers (or a ball bearing assembly used in place of the thrust washer assembly) is approximately 21 pounds. As Table 1 illustrates, significantly less force is required in the valve systems that include embodiments of the presently disclosed ball bearing assembly, resulting in significantly better control and operation of the valve systems.

TABLE 3

| Lever Type | Teflon Washer Configuration | Ball Bearing Configuration | Improvement (%) |
|---|---|---|---|
| Idle Lever Assembly | 14 oz | 10 oz | 40% |
| Mixture Control Lever | 12 oz | 8-10 oz | 17-33% |

Figure 13:
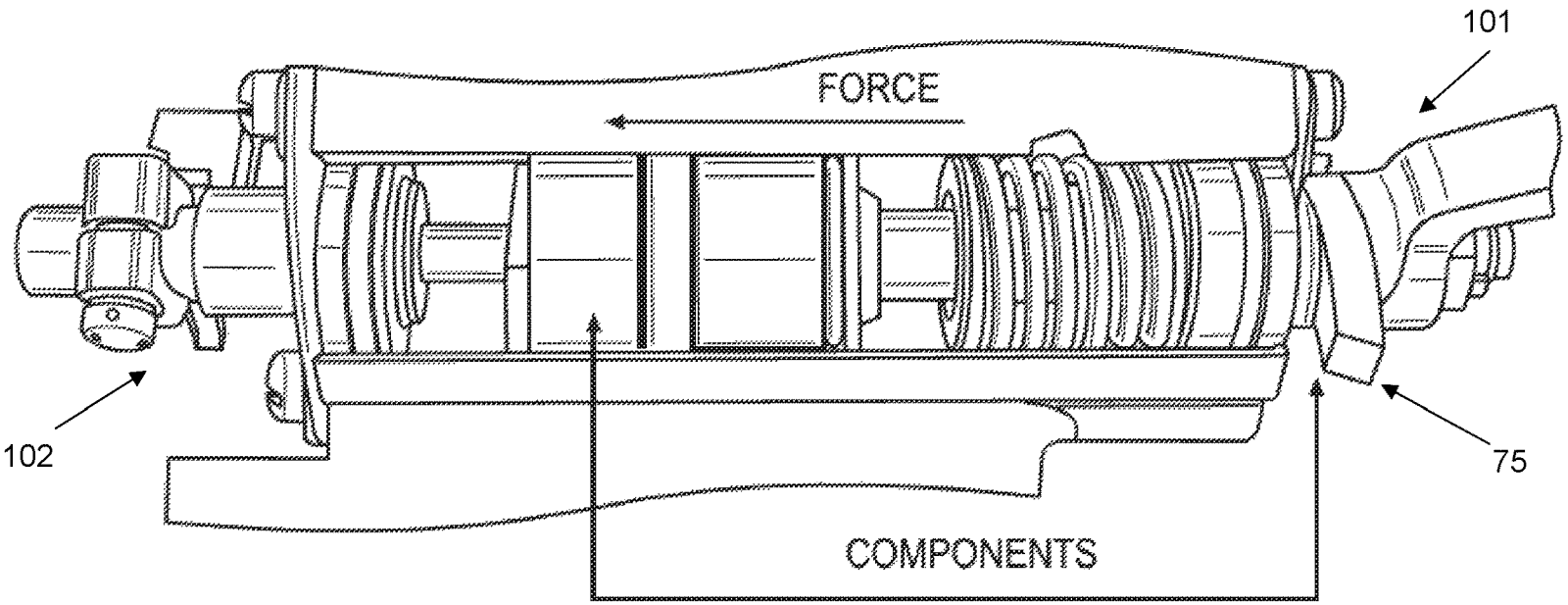
FIG. 13 is a perspective picture of the internal components of a mixture control assembly according to one embodiment of the present invention.
Figure 14:
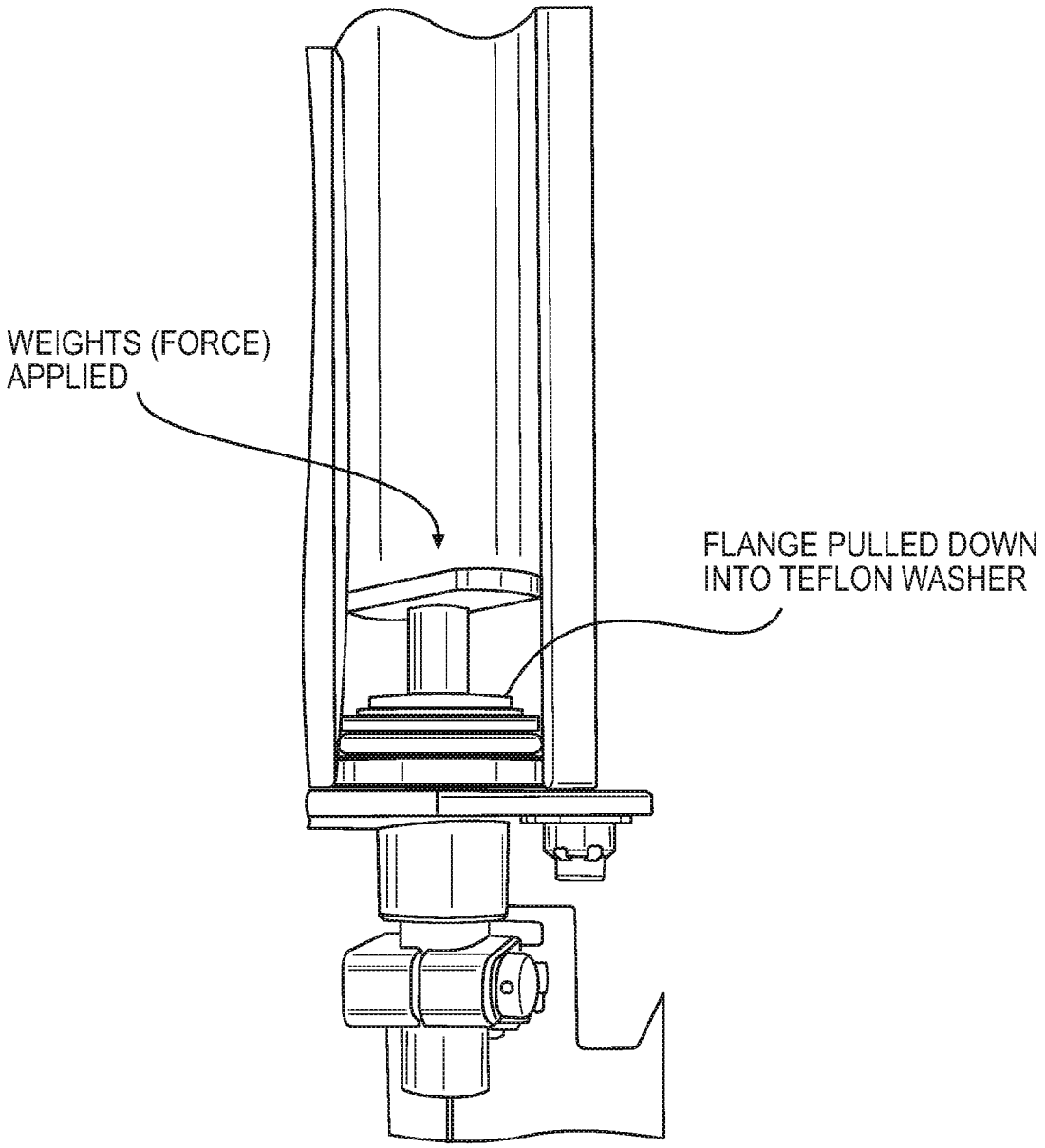
FIG. 14 is a perspective picture of a mixture control assembly according to one embodiment of the present invention as modified for test purposes.

To isolate how much friction is being imposed on the Teflon washer assembly or the replacement ball bearing assembly, a second test was performed with all items between the two arrows noted as "components" in FIG. 13 removed. Incrementally increasing weights were then attached to the outside of the idle lever assembly and the force required to initiate rotational movement were again recorded. FIG. 14 further illustrates this test configuration.

Table 2 contains the test result data. As illustrated, the exemplary ball bearing assembly presently disclosed herein resulted in significant reductions in friction regardless of the amount of force imparted on the system.

TABLE 4

| | Force Required to Initiate Movement | | |
|---|---|---|---|
| Weight Applied to Idle Lever Stem | Idle Lever with Teflon Washer | Idle Lever with Ball Bearing Assembly | Percentage Improvement |
| 8.36 lbs | 6 oz | 2 oz | 67% |
| 18.36 lbs | 12 oz | 2 oz | 83% |
| 28.36 lbs | 1 lbs, 2 oz (18 oz) | 2 oz | 89% |
| 33.36 lbs | 1 lbs, 8 oz (24 oz) | 2 oz | 92% |
| 43.36 lbs | 2 lbs, 4 oz (36 oz) | 4 oz | 89% |
| 53.36 lbs | 2 lbs, 12 oz (44 oz) | 6 oz | 86% |

Rotational Torque Test Summary:

Both types of tests show that the exemplary embodiment of the presently disclosed ball bearing assembly can reduce the amount of force required to initiate rotational movement compared to that of the Teflon washer assembly in the prior art. When the idle lever assembly was loaded with various weights, the ability of the tested ball bearing assembly to outperform the Teflon washer assembly was apparent. The unique design of the bushings, reduced spring, and etched stainless steel thrust washers, in various embodiments, all work to ease resistance in operation, thereby providing various advantages in the system. These advantages include, among other things, maintaining the components in place, limiting vibration, matching the width specs of the prior art designs, and providing sufficient spring tension necessary to keep the components secured.

Life Cycle Testing

Life cycle testing was also performed on the prior version of the system and then compared to an improved version employing certain embodiments of the presently disclosed ball bearing assembly. Tests were conducted using two RSA-5DA1™ servos with fully functional regulators and valve sections. Other test components included:

a) Two test fluids: Stoddard per Mil-PRF-7024 type II and Avgas 100LL;

b) Electric motors and linkage for cycling idle lever and mixture control levers;

c) Flow bench with fuel lines, fuel pump, flow meters, pressure gauges, etc.;

d) Idle lever assembly in stock configuration and idle lever assembly with ball bearing; and e) Mixture control lever assembly in stock configuration and mixture control lever assembly with ball bearing.

Description of Testing:

Two RSA-5AD1™ servos with operational regulators and valve areas were used for cycle testing both the mixture control lever and idle lever assemblies. An electric motor with special linkage and bracket were attached to each servo. The electric motor and linkage allowed the lever assemblies to be cycled back and forth, as they would be on an aircraft. The servos were plumbed into a flow bench. During the day, test fluid was run through the units. At night, the fluid pump was turned off. The test fluid that was in the servos after shutting off the fluid pump remained in the units during overnight testing.

The cycle rate at which the test lever assemblies were rotated through their full range of motion was 2.5 Hz. This rate is substantially higher than the rate at which the levers would normally be operated on the aircraft. For example, a pilot might move a lever 60 times in an hour, and only occasionally during operation would the levers would be moved through their full range of motion. The cycle rate of 2.5 Hz was therefore more stressful to the components located in the servo's valve area relative to normal operation. The idle and mixture control lever assemblies were removed from the servo's valve area periodically and inspected for wear.

Testing occurred throughout the night with the test fluid remaining stagnate in the servo. This allowed wear particles to build up in the servo's valve area. This was desirable because it further taxed the normal wear surfaces beyond their normal use.

Findings:

Numerous components in the servo's valve area rotate against each other when the idle lever and mixture lever are moved. During testing, these components were removed at various time intervals to inspect for wear. As one example, the amount of wear was compared to the same components taken out of servo cores that were sent in for overhaul. It was found that 2,000,000 test cycles created wear that was indicative of servos that met the Time Between Overhaul (TBO) specifications, thereby demonstrating the improved functionality of various embodiments of the presently disclosed valve system having ball bearing assemblies included therein.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. A fuel, mixture control assembly comprising:

a shaft;

a stop bracket adapted to be secured adjacent one end of the shaft;

a spring arranged over a portion of the shaft;

a spring retainer adapted to retain a first end of the spring opposite the stop bracket;

a retainer assembly comprising a C-ring washer adapted to engage at least one notch in the shaft and a C-washer retainer sized to seat the C-washer; and a bearing assembly arranged substantially between the spring retainer and the retainer assembly, wherein the bearing assembly comprises a thrust-bearing comprising a bearing race and a plurality of balls.

2. The fuel mixture control assembly of claim 1, wherein the C-washer retainer further comprises a lip.

3. The fuel mixture control assembly of claim 1, wherein the spring retainer comprises a rounded insert extending into a portion of an internal circumference of the spring.

4. The fuel mixture control assembly of claim 3, wherein the spring retainer comprises a shelf disposed about an outer circumference of the rounded insert.

5. The fuel mixture control assembly of claim 3, wherein the spring retainer comprises a flat surface opposite the rounded insert and the shelf.

6. The fuel mixture control assembly of claim 1, wherein the spring is made from stainless steel.

7. The fuel mixture control assembly of claim 1, further comprising a mixture control valve.

8. The fuel mixture control assembly of claim 1, wherein the bearing race comprises a plurality of spaces corresponding to each of the plurality of balls.

9. The fuel mixture control assembly of claim 1, wherein the hearing assembly comprises stainless steel.

10. The fuel mixture control assembly of claim 1, wherein the bearing assembly comprises ceramic.

11. The fuel mixture control assembly of claim 1, further comprising a bushing and a roll pin.

12. The fuel mixture control assembly of claim 1, wherein the C-washer and the C-washer retainer oppose the bearing assembly.

13. An idle fuel control assembly comprising:

a shaft;

a bracket adapted to be secured adjacent one end of the shaft;

an idle valve member rotationally engaged about the shaft;

a retainer assembly, wherein the retainer assembly comprises a C-washer adapted to engage at least one notch in the shaft, and a C-washer retainer sized to seat the C-washer; and a bearing assembly arranged adjacent the retainer assembly and the idle valve member, wherein the bearing assembly comprises a thrust-bearing comprising a bearing race and a plurality of balls.

14. The idle fuel control assembly of claim 13, wherein the bearing race comprises a plurality of spaces corresponding to each of the plurality of balls.

15. The idle fuel control assembly of claim 13, wherein the bearing assembly is made of any one of stainless steel and ceramic.

16. The idle fuel control assembly of claim 13, wherein the C-washer and the C-washer retainer oppose the bearing assembly.

17. The idle fuel control assembly of claim 13, wherein the spring retainer comprises a rounded insert extending into a portion of an internal circumference of the spring.

18. A fuel mixture control assembly comprising:

a shaft;

a stop bracket adapted to be secured adjacent one end of the shaft;

a spring arranged over a portion of the shaft;

a spring retainer adapted to retain a first end of the spring opposite the stop bracket, the spring retainer further comprising a rounded insert extending into a portion of an interior circumference of the spring, a shelf disposed about an outer circumference of the rounded insert, and a flat portion opposite the rounded insert and the shelf;

a retainer assembly comprising a C-washer adapted to engage at least one notch in the shaft, and a C-washer retainer sized to seat the C-washer and oppose the bearing assembly, the C-washer retainer further comprising a lip; and a bearing assembly disposed between the spring retainer and the retainer assembly, the bearing assembly comprising a thrust-bearing comprising a bearing race and a plurality of balls, wherein the bearing race comprises a plurality of spaces corresponding to each of the plurality of balls.

19. The fuel mixture control assembly of claim 18, wherein the bearing assembly is made of any one of stainless steel and ceramic.

20. The fuel mixture control assembly of claim 18, wherein the spring retainer comprises a rounded insert extending into a portion of an internal circumference of the spring.

* * * * *